United States Patent [19]

Ricard

[11] Patent Number: 4,899,441

[45] Date of Patent: Feb. 13, 1990

[54] METHOD AND APPARATUS FOR ATTACHING BAND SUPPORTED TERMINALS ON CONDUCTORS

[76] Inventor: Claude F. Ricard, Villa Sainte Madeleine - 52, Cours Gambetta, 13100 - Aix-en-Provence, France

[21] Appl. No.: 323,084

[22] Filed: Mar. 14, 1989

Related U.S. Application Data

[63] Continuation-in-part of Ser. No. 49,139, May 13, 1987, abandoned.

[30] Foreign Application Priority Data

May 16, 1986 [FR] France ..... 86 07158

[51] Int. Cl.[4] ..... H01R 43/04

[52] U.S. Cl. ..... 29/863; 29/753

[58] Field of Search ..... 29/857, 861, 862, 863, 29/748, 33 M, 753

[56] References Cited

U.S. PATENT DOCUMENTS 2,954,599 9/1960 Cootes .
3,019,679 12/1966 Schwalm .
3,030,694 4/1962 Kerstetter .
3,969,806 7/1976 McCaughey .
4,383,364 5/1983 Casey ..... 29/863
4,557,048 12/1985 Cordeiro ..... 29/863
4,667,397 5/1987 Day et al. ..... 29/748

FOREIGN PATENT DOCUMENTS 127330 5/1984 European Pat. Off. .
2183064 3/1985 France .
2153264 8/1985 United Kingdom .

*Primary Examiner*—Timothy V. Eley
*Attorney, Agent, or Firm*—Balogh, Osann, Kramer, Dvorak, Genova & Traub

[57] ABSTRACT

Apparatus for attaching terminals on conductor ends, being fixed between a stationary plate and a mobile plate of a fastening press. A plate which is fixed on the stationary plate and which comprises a passage and the means to feed into the passage a band bearing connected terminals fixed at right angles to the band. A carriage is provided which pivots 90° around an axis. The mobile plate bears stamper supports which bear two tightening stampers and an arm which rests on a pressing plate carried by the movable carriage.

4 Claims, 3 Drawing Sheets

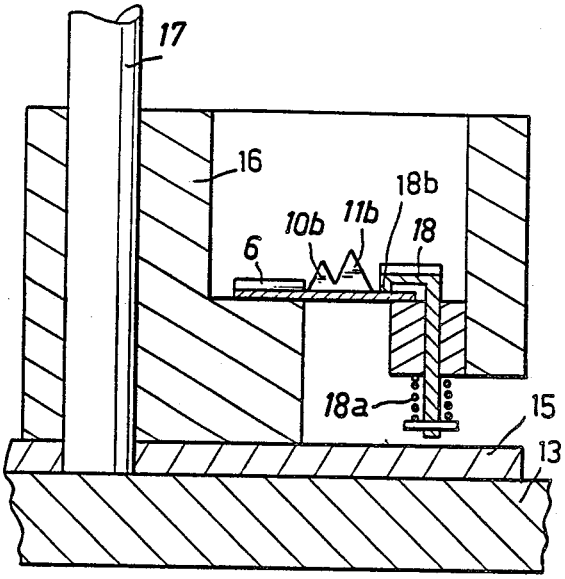
Fig. 5
Fig. 6
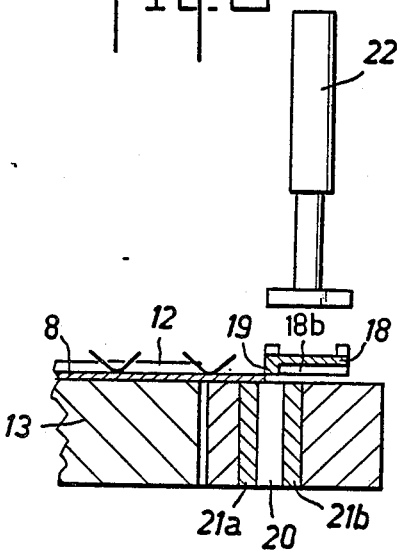
Fig. 8
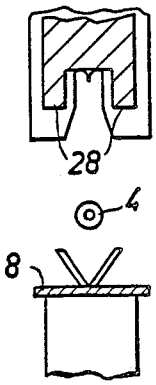
Fig. 7
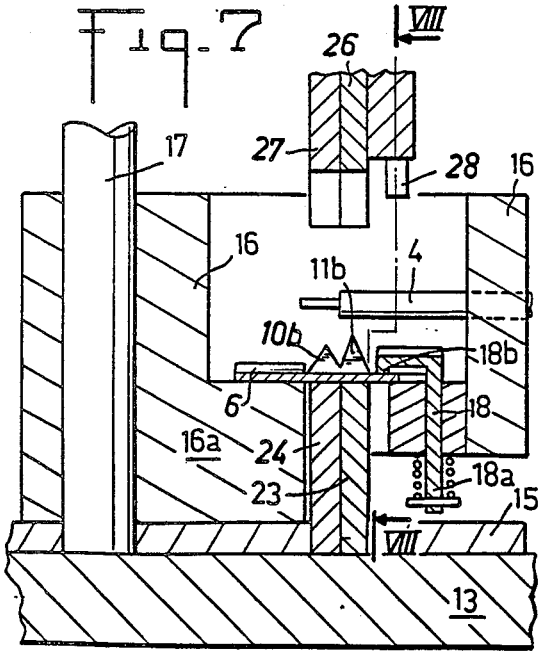

METHOD AND APPARATUS FOR ATTACHING BAND SUPPORTED TERMINALS ON CONDUCTORS

This is a continuation-in-part of co-pending application Ser. No. 049,139 filed on May 13, 1987, now abandoned.

The purpose of the present invention is a method and a device for the fastening tightly, on conductor wires, the connecting parts, such as terminals, attached sideways to an elongated band or strip.

The technical aspect of the invention is that of the construction of machines for wiring.

We are familiar with automatic wiring machines which reel a lead wire, which divide the latter as per the programmed length sections, which strip the wire tips and which present these tips to sundry operation stations among which a station for the automatic fastening, on each stripped tip, a completely known connecting part, for example, a part with rolled edges, a plug, a loop etc...

Patent application FR. A. 2,513,478 (81/18,181) (AUTOMATIC DEVICES AND ADVANCED TECHNIQUES - A.T.A. (abbreviation for French title) describes an automatic machine of this type bearing a conveyor for the transfer of wire tips constituted by a rotary plate which is driven by a motor controlled by a microprocessor, step-by-step, and which bears pairs of pivoting grippers which grasp each wire tip at two points, to form between them a variable length loop.

The devices in accordance with the invention are intended to equip, on a machine of this type, an operation station intended to fasten tightly the connecting parts on the stripped wire tips.

Certain connecting parts are manufactured in a series through puncher cutting of a metallic ribbon and, in this case, they are delivered on a coil on which the connecting parts are fixed sideways on a thin metal band which comprises the remaining part of the ribbon after the cutting of the connecting parts.

The connecting parts which are delivered in this form present problems by being fastened tightly, one after the other, on the wire tip presented by the transfer conveyor for an automatic wiring machine.

At known stations for fastening tightly, the coil on which is wound the band bearing connecting parts is quite cumbersome because it is arranged on the side of the fastening station, the axis of the coil being parallel to the longitudinal axis of the operation station, so that the connecting parts are presented parallel to the wire tips. Such arrangement is not good because of the coil obstruction. The fastening tools comprising two sets of die beds and stampers to effect the bending of the fins for fastening on the stripped tip of a lead wire and on the insulating duct of the latter are known as well as the die bed-stamper set allowing for the separation of each connecting part of the band which bears them, that is generally known as a connecting strip.

The purpose of the present invention is to provide means for arranging the coil, bearing the connecting parts, as an extension of the fastening station, the axis of the coil being perpendicular to the axis of the fastening station, so that the width of the fastening station is not increased given the obstruction of the coil.

This objective is reached by a method which comprises the following steps:

arrange the coil, bearing the connecting parts fixed sideways on a band, as an extension of a fastening station, the coil axis being perpendicular to the longitudinal axis of the station;

fix on the plates of a fastening press a manipulator device which comprises fastening die beds and stampers for the connecting parts and a carriage which pivots around a vertical axis;

introduce the band into a guiding track at the end before which the carriage is placed;

introduces the tip of the band into the carriage, the tip having a length equal to the step length between two connecting parts;

cut the band between the first and second connecting part to release the first connecting part;

pivot the carriage 90° to present the first connecting part for wire alignment;

move in the tip of a stripped wire above fastening fins of the first connecting part;

actuate a mobile plate of a press which bears the stampers which work with die bed stampers to fasten tightly on the wire the fastening fins and at the same time sever the band section attached to the connecting part;

elevate the movable plate, and remove the fitted wire, and recommence a new cycle by introducing the band tip in the carriage.

An object of the invention is to provide a device for the automatic fastening, on conductor wires of, connecting parts which are attached sideways on a metallic band which is wound on a coil, by means of a fastening press which comprises:

a plate which is fixed on one of the plates of the press and which comprises a guiding passage and the means for moving the band into the passage;

a pivoting carriage and the means to pivot the carriage 90° around a vertical axis between a first position where the carriage is placed at the end of the passage and a second position where it is arranged in the alignment of the position occupied with the wires during the fastening tightly, the carriage bearing a pressure segment which is equipped with a stamper which severs the band between the first and second connecting parts;

a rest for the stampers which rest is fixed on the other press plate and which bears two fastening stampers for the connecting parts on the wires and an arm which rests on the plunging section to have cut by the latter the section of the metallic band remaining fixed on each connecting part.

The invention has as a result the possibility of supplying an automatic fastening station with electrical connecting parts comprising part of a robot through connecting parts which are fixed sideways on a metallic band which is delivered wound on a coil and this by arranging the coil in the alignment of the fastening station, so that the obstacle of width of this station is not increased by the presence of a coil arranged on the side of the fastening station.

The following description refers to the attached drawings which represent, without any limitation, examples of the development of the devices as per the invention.

FIG. 5 is a partial section view as per V—V of FIG. 4.

FIG. 6 is a partial section as per VI—VI of FIG. 4.

FIG. 7 is a partial vertical section of the carriage in position II—II.

FIG. 8 is a partial section view as per VIII—VIII of FIG. 7.

FIG. 1 is a partial and schematic top view of an automatic wiring machine. This machine has a transfer conveyor for wire tips which conveyor is for example a circular plate 1 rotatively driven little by little about a vertical axis 2.

Plate 1 has, on its circumference, pairs of pivoting clamps 3*a*, 3*b*. Each pair of clamps grabs a tip of a wire 4 between two points and presents the tips of wire 4 in succession before sundry operation stations which are divided on the circumference of the plate 1.

Figure 1:
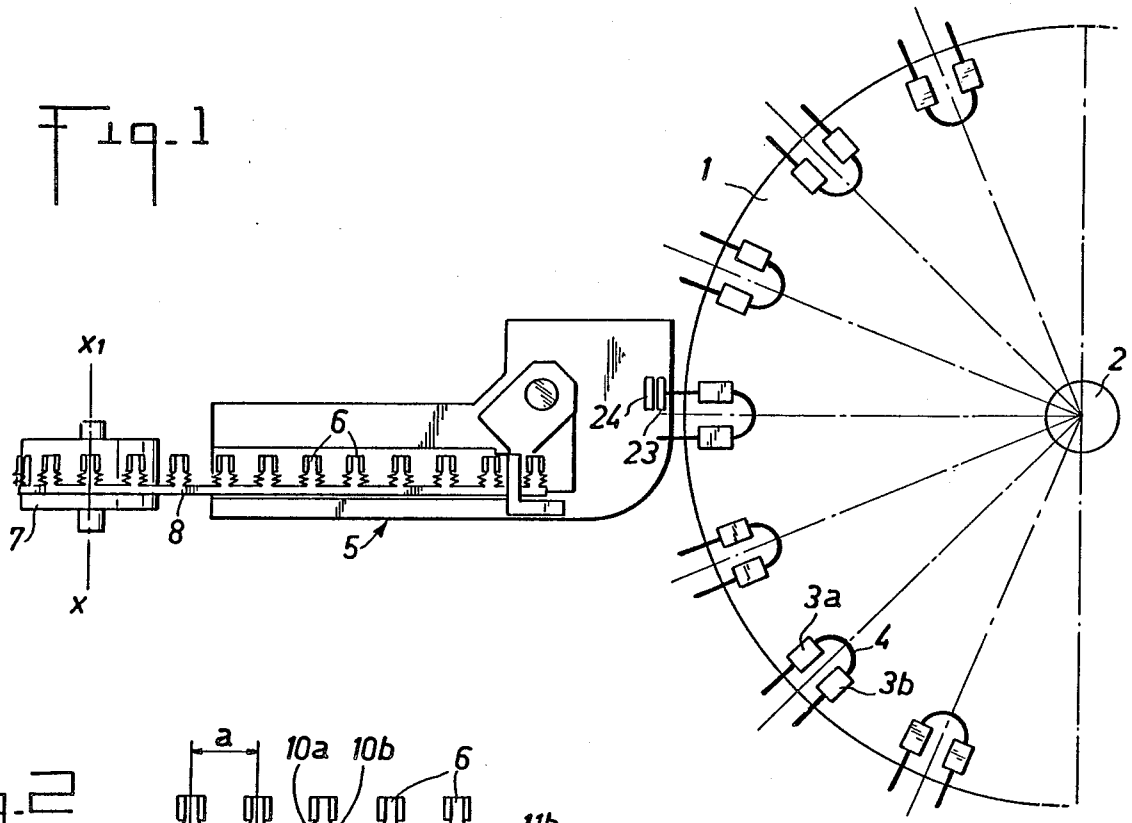
FIG. 1 is a schematic plan view of a portion of an automatic wiring machine.

FIG. 1 represents one of the operation stations 5 which is the fastening station for connecting parts on the bare tips of wires 4. The other operation stations are not represented for drawing clarity.

The operation station 5 receives connecting parts 6 which are delivered on a band wound on a coil 7.

Figure 2:
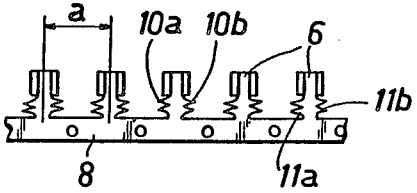
FIG. 2 is a top view of a portion of the band bearing lateral connecting parts.
Figure 3:
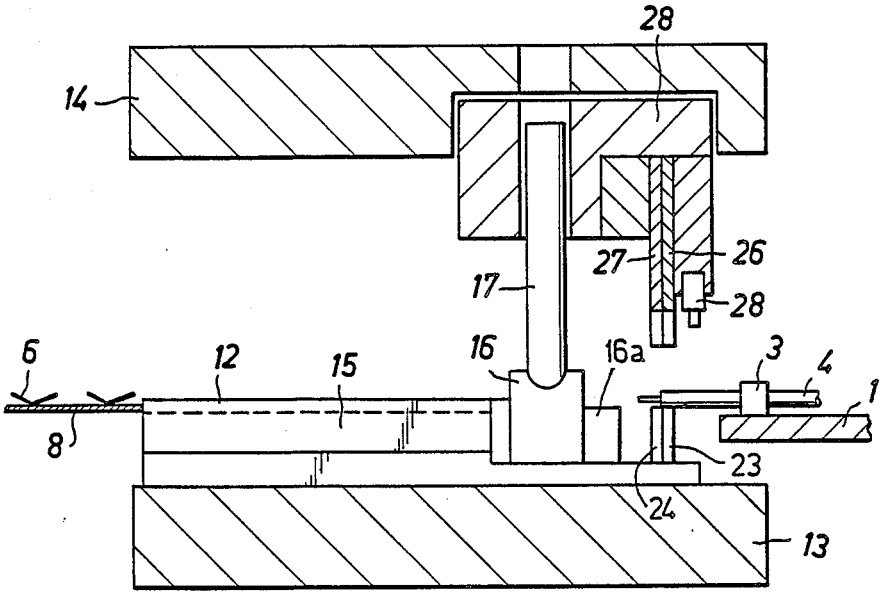
FIGS. 3 and 4 are vertical and plan section views of a device in accordance with the invention.

FIG. 2 represents a view of section of the band bearing the connecting parts. The connecting parts are formed on a thin metallic band 8, on which the connecting parts 6 are fixed sideways, the axis of parts 6 being perpendicular to the direction of movement of the band 8. The distance between parts 6 is equal to a constant step length *a*.

FIG. 2 represents female connecting parts with rolled edges but other parts can be used, such as male prongs, eyelets or any other equivalent connecting part. This connecting part 6 has two pairs of flattened fins, respectively the pair 10*a*, 10*b* which is intended to be fastened tightly on the bare conductor wire and the pair ll*a*, ll*b* which is intended to be fastened tightly on the insulating casing of the wire. Coil 7 on which the band of connecting parts 6 is wound is placed in the extension of operation station 5, an axis x-xl of the coil being perpendicular to the longitudinal axis of the operation station, so that the band 8 reels itself in an appreciably radial direction in relation to the plate 1.

Operation station 5 bears a guiding passage 12 in which the band 8 with the connecting parts passes and this passage is equipped with a pneumatic thrust arm which makes the band 8 move forward step by step through the passage, each step being equal to the step length a between two connecting parts. Operation station 5 has means for separating each connecting part 6 from the band 8, to the connecting part to lead it to the circumference of the plate 1 by having the part pivot 90°, so that the 13 connecting part is in line with the tips of the wire 4, the fastening fins 10*a*, 10*b*, ll*a* and ll*b* being situated adjacent the side of the plate 1 and the instruments to fasten these fins.

Illustrations 3 and 4 represent respectively a side view and a top view of a first process for making a device in accordance with the invention.

This device is assembled on two plates of a press for fastening tightly the connecting parts 6 on the wires 4 and includes a stationary lower plate 13 and upper plate 14 which is adjustable vertically in relation to the plate 13.

The stationary plate 13 has plate 15 on the surface of which is formed the guiding passage 12 for guiding the band 8 bearing the connecting parts 6.

Figure 4:
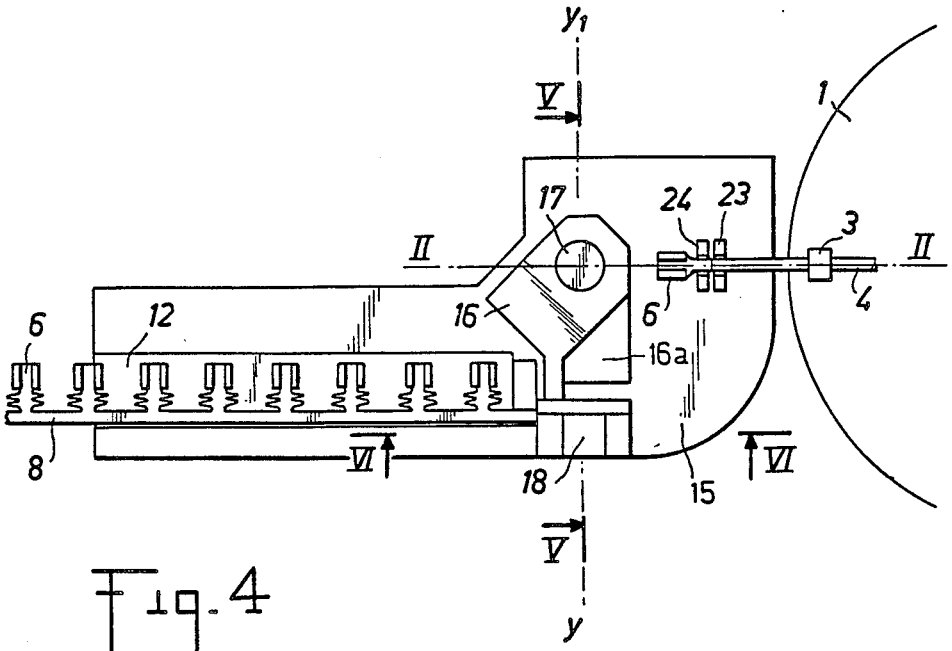

The device has a rotary carriage 16 which pivots around a vertical shaft 17 and which can occupy two positions, one position I of axis y-y1, represented on FIG. 4 and a position II displaced 90° when turned counter-clockwise.

Extension 16*a* slips on the upper face of the plate 15 which is fixed on the stationary lower plate 13 of a press.

The carriage 16 carries a plunging and pressing plate 18 which is seen in detail in FIGS. 5 and 6. This plate is held supported by a spring 18*a* against a junction between the metallic band 8 and the first connecting part 6 which is found parallel to axis y-y1. The pressing plate 18 is extended by a separator stamper 19, shown in FIG. 6, which is extended across the band 8. This stamper positions itself above a free space 20 demarcated by two plates 21*a*, 21*b* which constitute a separation die bed.

When you press down on the stamper 19, the stamper cuts the portion of the band 8 which connects the first connecting part to the others, so that the cut connecting part is held by the integral constriction of carriage 16 by the pressing plate 18, with its spring 18*a*.

The separator stamper 19 can be activated by a screw jack 22 which rests on the pressing plate 18, as is shown by FIG. 6. As a variable, the separator stamper can be activated by a push button on the movable plate 14 of the press which is displaced slightly towards the bottom to cut the band 8.

Once the band 8 is cut, a pneumatic jack screw operates on the carriage 16, to pivot it 90° counter-clockwise to bring it to the position II—II.

The connecting part 6 transported by the pivoting carriage 16 is placed in the fastening position II—II above two stationary die beds, die bed 23 which is used for the fastening of fins 11*a* and ll*b* on the insulating sleeve of the wire, and die bed 24 which is used for the fastening of fins 10*a* and 10*b* on the bare wire tips.

FIG. 7 represents a partial vertical section view along the fastening position II—II in FIG. 4. You see in this section view a part of the pressing plate 18 which is a part of the pivoting carriage 16 and the connecting part 6 which is placed above the die beds 23 and 24.

FIG. 8 represents a section view as per VIII—VIII of FIG. 7.

Once the mobile carriage 16 has brought a connecting part 6 in position II—II in FIG. 4, a tip of wire 4 is brought by the turning plate 1 above the connecting part, in such a way that this wire tip is found above the fastening fins 10*a*, 10*b* and ll*a*, ll*b* of part 6. For clarity of sketch, wire 4 is shown on FIGS. 7 and 8 above the connecting part 6.

The movable plate 14 of the press carries the stamper 26 which is found above the die bed 23 and functions to tighten the fins ll*a* and ll*b* on the insulating wire sleeve and stamper 27 which is found above die bed 24 and functions to fasten the fins 10*a* and 10*b* on the bare wire tips. The plate 14 has an arm rest 28.

After the wire 4 has been placed above the fastening fins, the mobile plate 14 is brought down, so that stampers 26 and 27, working with the die beds 23 and 24, will fasten the connecting part 6 on the tip of the wire 4.

At the same time, the arm rest 28 presses on the pressing plate 18 and the latter comprises a stamper which cuts the connection between connecting part 6 and the section of band 8.

Then the mobile plate 14 is lifted up, the stamper support goes up to release the pressing plate 18, whereby the band scrap is removed, by for example a stream of air, and the mobile carriage 16 is brought to the position y-y1 to take a new connecting part 6 and a new cycle recommences.

The shaft 17 maintains the stamper carrier and the mobile carriage 16 perfectly aligned. A centering pin allows for the positioning exactly of the carriage 16 into the position II—II, so that the stampers and the die beds may be placed exactly opposite one another.

FIGS. 3 to 6 represent a device in which the fastening die beds 23 and 24 are fixed.

When the first terminal 6 carried by a band 8 is aligned with axis yy' (FIG. 4), the tip of this terminal is put on the extension 16*a* as can be seen in FIG. 5. In this position, the first terminal is separated from the band 8 by the stamper 19 which shears the band between the first and the second terminals.

In the meantime, the member 18*b* is pressed against the junction of the first terminal with a portion of the band 8 which remains attached to the first terminal.

The first terminal is pinched between the member 18*b* and the extension 16*a* of the carriage by the action of the spring 18*a*. The first terminal cannot pivot and it follows the carriage 16, 16*a* when this latter pivots to go to the position II—II as shown in FIG. 4 which is a plan view of FIG. 7.

The height of the pressing member 18*b* measured from under the lower face of the member 18 is slightly less than the height of the stamper member 19 as can be seen in FIG. 6. The displacement of the screw jack 22 is adjusted so that it stops when the stamper member 19 has cut the band 8. At this time, the member 18*b* is pressed against the terminal.

The difference of height between the members 19 and 18*b* is equal to the thickness of the band 8, that is, about 0.1 mm.

What is claimed:

1. Method for fastening, on conductor wire ends, terminals which are fixed sideways on a band wound on a coil and which comprise fastening fins, said method comprising the following steps:

placing said coil in an extension of a fastening station comprising a fastening press having a mobile plate and a fixed plate, an axis of the coil being perpendicular to a longitudinal axis of the station;

fixing a manipulator device on said plates, said manipulator device comprising stampers and die beds for fastening terminals tightly on the conductor wire ends, and a carriage which pivots around a vertical axis and a guiding passage for said band;

introducing said band into said guiding passage and moving said band forward until a first terminal of said band is introduced in said carriage;

cutting said band between said first and second terminals to free said first terminal and a band section attached thereto;

pivoting said carriage 90° in order to present said first terminal aligned with a conductor wire end;

moving said conductor wire end between said fastening fins of said first terminal;

lowering said mobile plate of said press so that said stampers and said die beds fasten tightly said fastening fins on said wire end and simultaneously detaching said band section from said first terminal; and lifting up said mobile plate, removing said conductor wire end fitted with said first terminal, pivoting back said mobile carriage 90°, moving again said band forward in order to introduce said second terminal and a band section in said carriage and starting a new cycle.

2. Apparatus for fastening, on conductor wire ends, terminals fixed sideways on a metallic band would on a coil, said apparatus comprising:

a fastening press having a stationary lower plate and a mobile upper plate;

a frame member which is fixed on said lower plate and which comprises a guiding passage for said band, and means for forwarding said band into said passage;

a pivoting carriage and means for pivoting said carriage 90° around a vertical axis between a first position where said carriage is aligned with said guiding passage and a second position where said carriage is aligned with a conductor wire end, said carriage bearing a pressure segment which is equipped with a stamper to sever said band between two successive terminals; and a support for the stamper, which support is fixed on said mobile upper plate and which bears two stampers for fastening the terminals on the wire ends, and an arm which rests on said pressure segment which severs the metallic band section remaining fixed on each terminal.

3. Apparatus in accordance with claim 2, characterized in that the pivoting carriage bears, in addition, two die beds for the tightening of the terminals.

4. Apparatus in accordance with claim 2, characterized in that said pivoting carriage positions the terminals, when it occupies the second position, above the two stationary fastening die beds.

* * * * *